US007948441B2

(12) United States Patent
Irion, II et al.

(10) Patent No.: US 7,948,441 B2
(45) **Date of Patent: *May 24, 2011**

(54) LOW PROFILE ANTENNA

(75) Inventors: James M. Irion, II, Allen, TX (US); Robert S. Isom, Allen, TX (US)

(73) Assignee: Raytheon Company, Waltham, MA (US)

( * ) Notice: Subject to any disclaimer, the term of this patent is extended or adjusted under 35 U.S.C. 154(b) by 798 days.

This patent is subject to a terminal disclaimer.

(21) Appl. No.: 11/734,517

(22) Filed: Apr. 12, 2007

(65) Prior Publication Data

US 2008/0252544 A1 Oct. 16, 2008

(51) Int. Cl.
*H01Q 13/00* (2006.01)

(52) U.S. Cl. ..... 343/772

(58) Field of Classification Search ..... 343/700 MS, 343/793, 795, 797, 820–822, 846, 8
See application file for complete search history.

(56) References Cited

U.S. PATENT DOCUMENTS

| | | | | |
|---|---|---|---|---|
| 3,740,754 | A | 6/1973 | Epis | 343/797 |
| 3,976,959 | A * | 8/1976 | Gaspari | 333/26 |
| 5,255,005 | A * | 10/1993 | Terret et al. | 343/895 |
| 5,594,455 | A | 1/1997 | Hori et al. | 343/700 |
| 5,874,924 | A | 2/1999 | Csongor et al. | 343/797 |
| 6,024,812 | A | 2/2000 | Bley et al. | 149/92 |
| 6,097,349 | A * | 8/2000 | Sanford | 343/859 |
| 6,114,997 | A | 9/2000 | Lee et al. | 343/700 |
| 6,147,653 | A * | 11/2000 | Wallace et al. | 343/702 |
| 6,239,755 | B1 * | 5/2001 | Klemens et al. | 343/702 |
| 6,300,906 | B1 | 10/2001 | Rawnick et al. | 343/700 |
| 6,310,585 | B1 * | 10/2001 | Marino | 343/818 |
| 7,102,582 | B2 * | 9/2006 | Sato | 343/767 |
| 7,388,556 | B2 * | 6/2008 | Zimmerman | 343/833 |
| 7,688,265 | B2 * | 3/2010 | Irion et al. | 343/700 MS |
| 2005/0001778 | A1 * | 1/2005 | Le et al. | 343/810 |
| 2005/0219008 | A1 | 10/2005 | De Flaviis | 333/26 |
| 2006/0232486 | A1 | 10/2006 | Bisiules al. | |
| 2006/0232489 | A1 | 10/2006 | Bisiules et al. | 343/797 |
| 2006/0279471 | A1 | 12/2006 | Zimmerman | 343/818 |
| 2009/0073075 | A1 | 3/2009 | Irion, II et al. | |

FOREIGN PATENT DOCUMENTS

| | | | |
|---|---|---|---|
| DE | 20 2004 008 770 | U1 | 9/2004 |
| EP | 0 323 664 | A2 | 7/1989 |
| EP | 1 367 672 | A1 | 3/2003 |
| EP | 1 879 256 | A1 | 1/2008 |
| GB | 22 424 765 | A | 4/2006 |
| JP | 62216502 | | 9/1987 |
| WO | WO 01/31735 | A1 | 5/2001 |
| WO | WO 2006/114455 | A1 | 2/2006 |

OTHER PUBLICATIONS

European Search Report; Application No. 08006242.5-2220; date: Jul. 10, 2008; 8 pages.

(Continued)

*Primary Examiner* — Huedung Mancuso
(74) *Attorney, Agent, or Firm* — Baker Botts L.L.P.

(57) ABSTRACT

In one embodiment, a low profile antenna according to the present invention comprises a balanced transmission line, electronic circuitry, and a parasitic element. The electronic circuitry is coupled to an interconnecting end of the transmission line and operable to direct electromagnetic energy through the transmission line to a terminating end. The parasitic element has a surface that is disposed at a predetermined distance from the terminating end and normal to the central axis such that the surface of the parasitic element covers an opening formed by the terminating end.

20 Claims, 3 Drawing Sheets

OTHER PUBLICATIONS

I-Jen Chen, "CPW-Fed Circularly Polarized 2x2 Sequentially Rotated Patch Antenna Array," Microwave Conference Proceedings, IEEE, vol. 4, pp. 1-3, XP010902322, Dec. 4, 2005.

Guang-Jong Chou et al, "Oscillator-Type Active-Integrated Antenna: The Leaky-Mode Approach," Dec. 1, 1996, vol. 44, No. 12, 8 pages, IEEE.

PCT Notification of Transmittal of the International Search Report and the Written Opinion of the International Searching Authority, or the Declaration, mailed Nov. 6, 2008, in re PCT/US2008/073623 filed Aug. 20, 2008 (19 pages).

Office Action from for U.S. Appl. No. 11/857,279; 8 pages, Dec. 26, 2008.

U.S. Appl. No. 11/857,279, entitled "Dual Polarized Low Profile Antenna,"; (31 pages), Sep. 18, 2007.

Irion II et al., Response Pursuant to 37 C.F.R. §1.111, U.S. Appl. No. 11/857,279, Filed Mar. 19, 2009, 8 pages.

USPTO, "Office Action Summary," U.S. Appl. No. 11/857,279, Mailed May 11, 2009, 7 pages, Mailed Dec. 26, 2008.

Irion II et al., Response Pursuant to 37 C.F.R. §1.111, U.S. Appl. No. 11/857,279, Filed Aug. 10, 2009, 9 pages.

Irion et al., "Notice of Allowance and Fee(s) Due," 4 pages, Mailed Nov. 17, 2009, U.S. Appl. No. 11/857,279.

* cited by examiner

LOW PROFILE ANTENNA

TECHNICAL FIELD OF THE DISCLOSURE

This disclosure generally relates to antennas, and more particularly, to a low profile antenna and a method of constructing the same.

BACKGROUND OF THE DISCLOSURE

An antenna is a type of device that is adapted to transmit and/or receive electromagnetic energy. For electromagnetic energy in the microwave frequencies, numerous differing types of antenna structures have been developed. One particular type of microwave antenna is the microstrip or patch antenna. Characteristic aspects of the patch antenna may include its relatively narrow bandwidth and low physical depth profile. Another popular type of microwave antenna is the notch antenna of which the flared notch antenna and cross notch antenna are several variations of the same. The notch antenna possesses a characteristically broader bandwidth than the patch antenna, yet requires a depth profile that is at least approximately ¼ wavelength at the lowest desired operating frequency.

SUMMARY OF THE DISCLOSURE

In one embodiment, a low profile antenna comprises a balanced transmission line, electronic circuitry, and a parasitic element. The electronic circuitry is coupled to an interconnecting end of the transmission line and operable to direct electromagnetic energy through the transmission line to a terminating end. The parasitic element has a surface that is disposed at a predetermined distance from the terminating end and normal to the central axis such that the surface of the parasitic element covers an opening formed by the terminating end.

In another embodiment, a method for constructing a low profile antenna comprises providing a low profile antenna, determining the desired operating parameters of the antenna, and matching the impedance of the transmission line to free space. The low profile antenna generally includes a balanced transmission line, electronic circuitry, and a parasitic element. The electronic circuitry is coupled to an interconnecting end of the transmission line and operable to direct electromagnetic energy through the transmission line to a terminating end. The parasitic element has a surface that is disposed at a predetermined distance from the terminating end and normal to the central axis such that the surface covers an opening formed by the terminating end.

Certain embodiments may provide numerous technical advantages. A technical advantage of one embodiment may provide an antenna having a relatively low depth profile while having a relatively wide bandwidth of operation. While other prior art implementations such as notch antennas have a relatively wide bandwidth, they require a profile that is generally at least a ¼ wavelength at the lowest frequency of operation. Certain embodiments may provide an operating bandwidth that is comparable to and yet have a depth profile significantly less than notch antenna designs.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Figure 1:
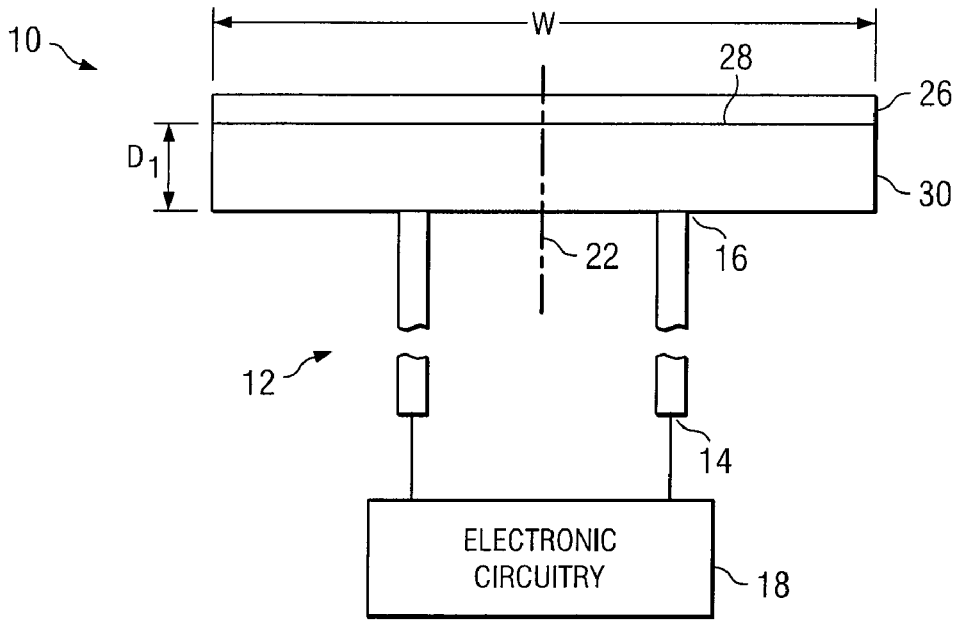
FIG. 1 is an illustration of one embodiment of a low profile antenna.

Embodiments of the invention now will be described more fully below with reference to the accompanying drawings. Reference numerals used throughout this document refer to like elements in the drawings.

FIG. 1 shows one embodiment of a low profile antenna 10. The low profile antenna 10 generally comprises a balanced transmission line 12 having an interconnecting end 14, and a terminating end 16, electronic circuitry 18 coupled to the interconnecting end 14, and a parasitic element 26 disposed a predetermined distance from the terminating end 16. The balanced transmission line 12 may be made of any electrically conducting material and has a channel defining a central axis 22. The electronic circuitry 18 may be operable to manipulate electromagnetic energy that is directed from the interconnecting end 14 to the terminating end 16 of the balanced transmission line 12 along the direction of the central axis 22. The electrical component of the electromagnetic energy has a direction of polarization that may be generally perpendicular to the balanced transmission line 12 and to the electromagnetic energy's direction of propagation. The electronic circuitry 18 may include any electrical component that is adapted to convert electromagnetic energy suitable for use by the low profile antenna 10.

In one embodiment, the parasitic element 26 may be a flat plate made of a conducting material such as metal. The parasitic element 26 has a surface 28 that is generally perpendicular to the central axis such and covers an opening formed by the terminating end. In another embodiment, the low profile antenna 10 may include a dielectric layer 30 that is disposed in between the terminating end 16 of the balanced transmission line 12 and surface 28 of the parasitic element 26.

The balanced transmission line 12 may be a slotline, twinline, parallel plate, or other type of balanced structure. In one embodiment, the transmission line 12 has a length that is significantly shorter than the wavelength ($\lambda$) of the desired frequency of operation. The length of the transmission line 12 is the distance from the interconnecting 14 to the terminating 16 end. In another embodiment, the length of the transmission line may be less than ¼ wavelength of the operating frequency of the low profile antenna 10. In yet another embodiment, the length of the transmission line may be as low as approximately 1/10 the operating frequency of the low profile antenna 10. In this manner, a low profile antenna 10 may be constructed having a relatively low profile compared to known antenna designs with similar functionality. Therefore, tuning of the low profile antenna 10 is not accomplished by the transmission line 12; rather, tuning of the antenna is accomplished using the one or more parasitic elements 26 as will be described in detail below.

Certain embodiments may provide coupling of the terminating end 16 of a balanced transmission line 12 to free space using the parasitic element 26. Stated another way, the parasitic element 26 may be operable to match the impedance (Z) of the balanced transmission line 12 to free space. It is known that relatively efficient coupling of an antenna to free space occurs when the output impedance of the antenna is approximately 377 ohms, the characteristic impedance of free space. To accomplish this, particular physical characteristics of the parasitic element 26 or dielectric layer 30 may be selected in order to manipulate the output impedance of the low profile antenna 10. In one embodiment, a width W of the parasitic element 26 may be selected in order to manipulate the output impedance of the low profile antenna 10. In another embodiment, the dielectric layer 30 may be selected to have a predetermined depth $D_1$. In this manner, the parasitic element 26 may be disposed a predetermined distance from the terminating end 16 that is essentially equal to depth $D_1$.

In another embodiment, the dielectric layer 30 may be made of a material having a predetermined dielectric constant selected to manipulate the output impedance of the low profile antenna 10. In yet another embodiment, the dielectric layer 30 may be an open gap such that the dielectric layer 30 is made of air. Given the insulative aspects of the dielectric layer 30, the parasitic element 26 has no direct coupling to the electronic circuitry 18 through the transmission line 12. Thus, the dielectric layer 30 may serve a dual purpose of providing structural support for the parasitic element 26 relative to the transmission line 12 as well as to provide another approach of manipulating the output impedance of the low profile antenna 10.

The parasitic element 26 is shown centrally disposed over the transmission line 12; however, this is not necessary. In fact, the parasitic element 26 may be offset relative to the transmission line 12 in order to further manipulate various operating parameters of the low profile antenna 10. The term "offset" is referred to as placement of the parasitic element 26 over the transmission line 12 in such a manner that the transmission line 12 does not lie proximate the central portion of the parasitic element 26. Thus, the parasitic element 26 may be disposed in any manner such that the parasitic element 26 lies over the opening formed by the terminating end 16 of the balanced transmission line 12.

Figure 2:
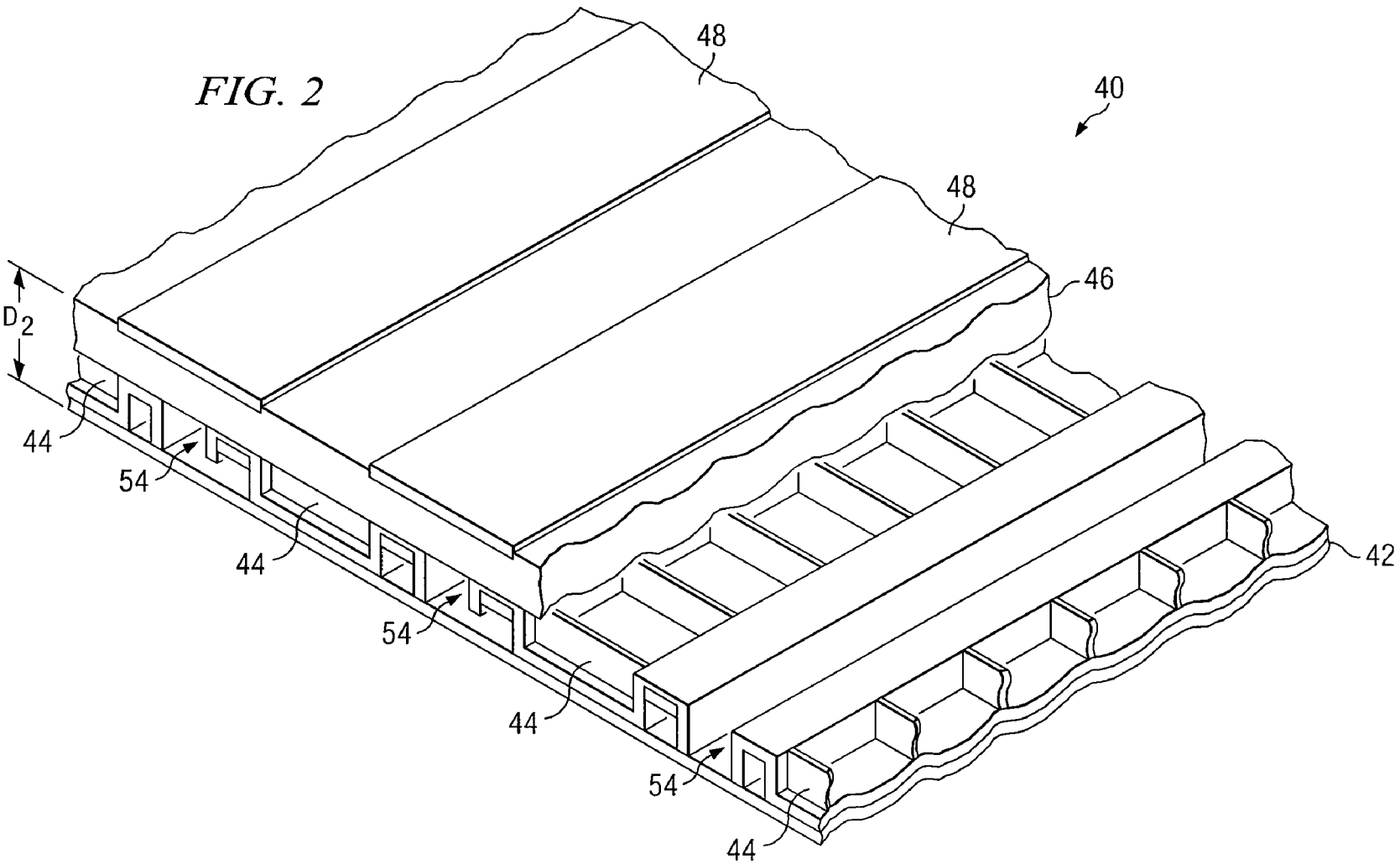
FIG. 2 is a perspective view of another embodiment of a low profile antenna.

FIG. 2 depicts another embodiment of a low profile antenna 40 in which a number of balanced transmission lines 54 and parasitic elements 48 may be configured to transmit or receive electromagnetic energy. Each transmission line 54 and parasitic element 48 functions in a similar manner to the transmission line 12 and parasitic element 26 respectively of FIG. 1. However, the embodiment of FIG. 2 differs in that multiple transmission lines 54 and associated parasitic elements 48 may be used in order to form an array.

The low profile antenna 40 may be referred to as an array because multiple transmission lines 54 are associated with a corresponding multiple parasitic elements 48. The low profile antenna 40 generally comprises a manifold board 42, a plurality of metallic frames 44, one or more dielectric layers 46, and one or more parasitic elements 48. The metallic frames 44 may be configured to serve as one or more baluns as well as one or more transmission lines 54 (to be described below). The manifold board 42 may include circuitry that may be operable to convey an electrical signal from an unbalanced line to each of the one or more U-shaped members 56 functioning as baluns. The unbalanced signal may be provided by any typical unbalanced transmission line (not specifically shown) that may be, for example, a coaxial cable, unbalanced t-line feed, stripline, or a microstrip. In one embodiment, the low profile antenna 10 has a depth profile $D_2$ that is relatively short as compared with other known antenna designs.

Figure 3:
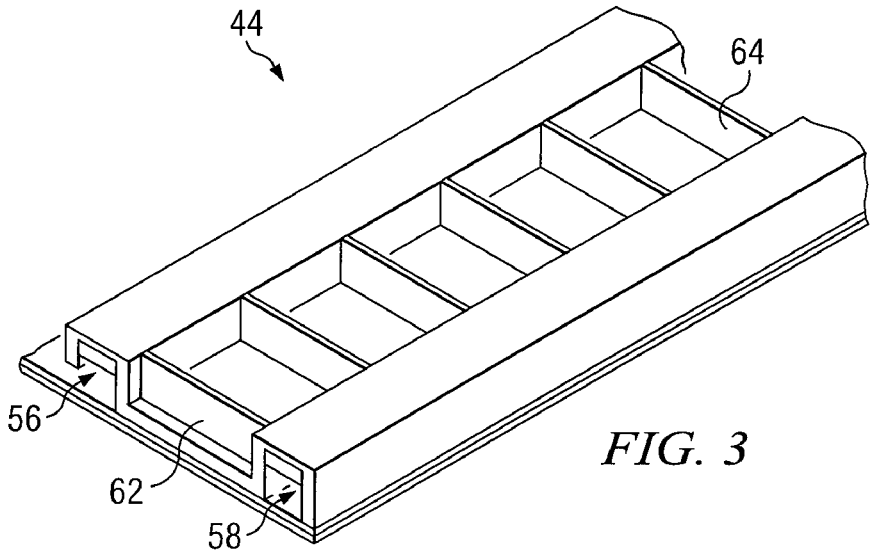
FIG. 3 is a perspective view of a metallic frame that may be used in conjunction with the embodiment of FIG. 2.

FIG. 3 shows one metallic frame 44 that has been removed from the low profile antenna 40. The metallic frame 44 has two inverted U-shaped members 56 and 58 that are interconnected by a cross member 62. One or more optional ribs 64 may be included to provide structural rigidity to the dielectric layer 46. As will be described below, the plurality of metallic frames 44 may be combined in such a manner to form the one or more transmission lines 54.

Figure 4:
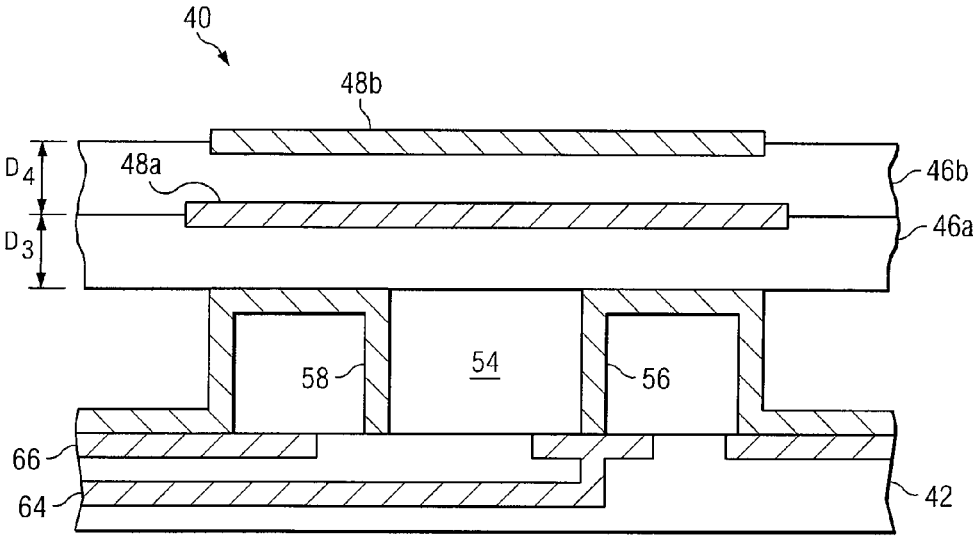
FIG. 4 is a partial elevational view of the embodiment of FIG. 2.

FIG. 4 is a partial elevational view of the embodiment of FIG. 2. As shown, a balanced transmission line 54 may be formed by adjacently disposed U-shaped members 56 and 58. U-shaped member 56 forms a folded balun that is operable to convert an unbalanced signal comprising electromagnetic energy to a balanced signal suitable for use by the balanced transmission line 54. The U-shaped member 56 is connected to a feed line 64 that may be in turn, connected to an unbalanced line such as a coaxial cable, unbalanced t-line feed, stripline, or a microstrip feed line (not specifically shown). U-shaped member 58 may be connected to a ground plane 66. Thus, the balun, which is formed by U-shaped member 56, feed line 64, and ground plane 66 may form a portion of an electronic circuit that is operable to provide a balanced signal comprising electromagnetic energy to the balanced transmission line 54.

In this particular embodiment, two parasitic elements 48*a* and 48*b* are disposed over each of the U-shaped members 56 and 58. Thus, the low profile antenna 40 may have multiple parasitic elements 48*a* and 48*b* that serve to couple electromagnetic energy from the transmission line 54 to free space. Neither of the parasitic elements 48*a* and 48*b* have any direct coupling to the transmission line 54 or to each other. Isolation of the parasitic elements 48*a* and 48*b* is accomplished by two associated dielectric layers 46*a* and 46*b*. Dielectric layer 46*a* serves to separate parasitic element 48*a* from the balanced transmission line 54 by a predetermined distance $D_3$. The second dielectric layer 46*b* serves to separate parasitic element 48*b* from parasitic element 48*b* by a second predetermined distance $D_4$. In a similar manner to the low profile antenna 10 of FIG. 1, the dimensional qualities of parasitic element 48*a* and dielectric layer 46*a* may be selected in order to manipulate the output impedance of the low profile antenna 40. Additionally, the dimensional qualities of the second parasitic element 48*b* and second dielectric layer 46*b* may also be selected to further manipulate the output impedance of the low profile antenna 40. Although embodiments are described herein in which a quantity of two parasitic elements 48*a* and 48*b* are shown, it should be appreciated that any number of parasitic elements 48 may be used.

Figure 5:
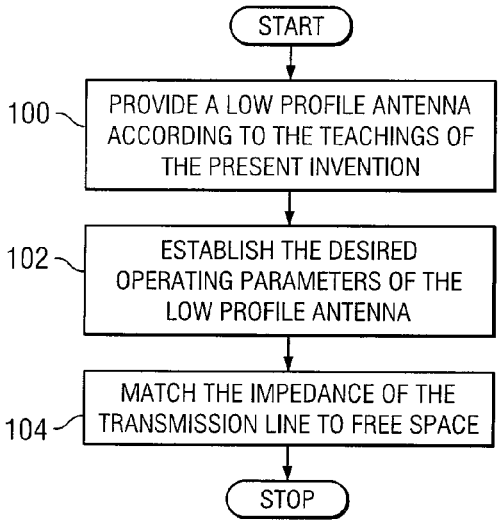
FIG. 5 is a flowchart depicting a series of acts that may be utilized to construct the low profile antenna according to the embodiments of FIG. 1 or FIG. 2.

FIG. 5 shows a series of actions that may be performed in order to construct the low profile antenna 10 or 40. In act 100, a low profile antenna 10 or 40 may be provided according to the embodiments of FIG. 1 or FIGS. 2 through 4 respectively. Next in act 102, the desired operating parameters of the low profile antenna 10 or 40 may be established. The desired operating parameters of the low profile antenna 10 or 40 may include a frequency of operation, a frequency bandwidth (BW), and a two-dimensional scan capability. For example, it may be desirable to construct a low profile antenna having an operating frequency of 12 Giga-Hertz at an operating bandwidth of 3:1 and a two-dimensional scan capability of 45 degrees. These desired operating parameters describe only one example of a low profile antenna 10 or 40 that may be constructed. It should be appreciated that a low profile having operating and physical parameters other than those described above may be constructed according to the teachings of the present disclosure.

Once the desired operating parameters have been established, the impedance of the transmission line 12 or 54 is generally matched to free space over the desired bandwidth of frequencies in act 104. It should be appreciated that the act of matching the transmission line 12 or 54 to free space is not intended to provide a perfect match over the entire range of desired operating bandwidth. However, the terminology "matched" is intended to indicate a level of impedance matching over the desired range of operating frequencies sufficient to allow transmission and/or reception of electromagnetic energy from free space to the low profile antenna 10 or 40. The act of matching the transmission line 12 or 54 to free space may be accomplished by selecting one or more physical characteristics of the low profile antenna 10 or 40. The physical characteristics may include selecting the width of each of the one or more parasitic element 26 or 48, selecting a depth of the dielectric layer 30 or 46, selecting a dielectric constant of the material from which the dielectric layer 30 or 46 is formed, the number of parasitic elements 26 or 48 used, or the level of offset of the parasitic element 26 or 48 relative to the transmission line 12 or 54. It should be understood that other physical characteristics than those disclosed may be operable to modify the operating parameters of the low profile antenna 10 or 40. However, only several key physical characteristics have been disclosed for the purposes of brevity and clarity of disclosure.

Test results of an actual reduction to practice determine that the low profile antenna 40 may be designed having a frequency of operation in the range of 6 to 18 Giga-Hertz having a frequency bandwidth of 3:1. Additionally, the low profile antenna 40 may have an overall depth $D_2$ of approximately 1/10 wavelength at the lowest operating frequency. The given operating parameters described above may be accomplished by implementing a quantity of two parasitic elements 48. Thus, it may be seen that a low profile antenna 40 may be realized having a relatively wide bandwidth in conjunction with a relatively low depth profile.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

What is claimed is:

1. A low profile antenna comprising:

a pair of parallel plates defining a balanced transmission line having an interconnecting end, a terminating end, and a channel defining a central axis, one of the parallel plates forming a portion of a folded balun and the other one of the parallel plates being coupled to a ground plane, the interconnecting end being coupled to an unbalanced transmission line;

at least one generally flat parasitic element having a surface that is disposed at a predetermined distance from the terminating end and normal to the central axis such that the surface covers an opening formed by the terminating end, the at least one generally flat parasitic element operable to match the impedance of the balanced transmission line to free space; and a dielectric layer disposed in between the terminating end of the balanced transmission line and the surface of the parasitic element.

2. The antenna of claim 1, wherein the at least one parasitic element comprises at least two parasitic elements.

3. The antenna of claim 1, wherein the transmission line has a length that is less than ¼ of the wavelength of the operating frequency of the low profile antenna.

4. An antenna comprising:

a balanced transmission line having an interconnecting end, a terminating end, and a channel defining a central axis;

electronic circuitry coupled to the interconnecting end and operable to direct electro-magnetic energy towards the terminating end along a direction of propagation, the direction of propagation being essentially co-linear with the central axis; and at least one parasitic element having a surface that is disposed at a predetermined distance from the terminating end and normal to the central axis such that the surface covers an opening formed by the terminating end, the at least one parasitic element operable to match the impedance of the balanced transmission line to free space.

5. The antenna of claim 4, wherein the parasitic element is a generally flat plate.

6. The antenna of claim 4, wherein the electronic circuitry comprises a balun.

7. The antenna of claim 6, wherein the balun is a folded balun.

8. The antenna of claim 4, wherein the electronic circuitry comprises a ground plane.

9. The antenna of claim 4, wherein the balanced transmission line comprises a pair of parallel plates.

10. The antenna of claim 9, wherein each of the parallel plates forms a portion of a folded balun.

11. The antenna of claim 4, wherein the antenna has an operating bandwidth of approximately 3:1.

12. The antenna of claim 4, wherein the balanced transmission line is a slotline, twinline, or parallel plate.

13. The antenna of claim 4, further comprises a dielectric layer disposed in between the terminating end of the balanced transmission line and the surface of the parasitic element.

14. The antenna of claim 4, wherein the at least one parasitic element comprises at least two parasitic elements.

15. The antenna of claim 4, wherein the transmission line has a length that is less than ¼ of the wavelength of the operating frequency of the low profile antenna.

16. A method of constructing and antenna comprising:

providing an antenna comprising a balanced transmission line having an interconnecting end, a terminating end, and a channel defining a central axis, electronic circuitry coupled to the interconnecting end and operable to direct electro-magnetic energy towards the terminating end along a direction of propagation, the direction of propagation being essentially co-linear with the central axis, and at least one parasitic element having a surface that is disposed at a predetermined distance from the terminating end and normal to the direction of propagation such that the surface covers an opening formed by the terminating end, the at least one parasitic element operable to match the impedance of the balanced transmission line to free space;

determining the desired operating parameters of the antenna; and matching the impedance of the transmission line to free space.

17. The method of claim 1, wherein matching the impedance of the transmission line to free space further comprises selecting a width of the at least one parasitic element.

18. The method of claim 1, wherein matching the impedance of the transmission line to free space further comprises selecting a depth of the dielectric layer.

19. The method of claim 1, wherein matching the impedance of the transmission line to free space further comprises selecting a dielectric constant of the material from which the dielectric layer is formed.

20. The method of claim 1, wherein matching the impedance of the transmission line to free space further comprises selecting a quantity of the at least one parasitic elements.

* * * * *